US006580891B1

(12) United States Patent
Meyer et al.

(10) Patent No.: US 6,580,891 B1
(45) Date of Patent: Jun. 17, 2003

(54) APPARATUS AND METHOD FOR NON-INTERACTIVE MAGNETIC BRUSH DEVELOPMENT

(75) Inventors: Robert J. Meyer, Penfield, NY (US); Dale R. Mashtare, Bloomfield, NY (US); John F. Knapp, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/995,654

(22) Filed: Nov. 29, 2001

(51) Int. Cl.[7] ..... G03G 15/09
(52) U.S. Cl. ..... 399/267
(58) Field of Search ..... 399/267, 270, 399/271, 276, 277, 290, 291, 292, 293, 274

(56) References Cited

U.S. PATENT DOCUMENTS

| | | | | | |
|---|---|---|---|---|---|
| 4,233,387 | A | | 11/1980 | Mammino et al. | 430/137 |
| 4,295,443 | A | * | 10/1981 | Kohyama | 399/270 |
| 4,345,014 | A | | 8/1982 | Oka et al. | 430/122 |
| 4,546,060 | A | | 10/1985 | Miskinis et al. | 430/108 |
| 4,546,722 | A | * | 10/1985 | Toda et al. | 399/267 |
| 4,727,823 | A | * | 3/1988 | Thompson et al. | 399/277 |
| 4,937,166 | A | | 6/1990 | Creatura et al. | 430/108 |
| 5,255,059 | A | * | 10/1993 | Kai et al. | 399/265 |
| 5,414,497 | A | * | 5/1995 | Tsuchiya et al. | 399/272 |
| 5,505,760 | A | | 4/1996 | Jansson | 75/255 |
| 5,809,385 | A | * | 9/1998 | Snelling et al. | 399/266 |
| 5,826,151 | A | * | 10/1998 | Genovese | 399/277 |
| 5,890,041 | A | | 3/1999 | Lewis | 399/276 |
| 5,914,209 | A | | 6/1999 | Grushkin | 430/106.6 |
| 5,946,534 | A | | 8/1999 | Lewis | 399/272 |
| 6,035,170 | A | * | 3/2000 | Snelling | 399/266 |
| 6,143,456 | A | | 11/2000 | Silence et al. | 430/106.6 |
| 6,321,055 | B1 | * | 11/2001 | Mashtare et al. | 399/266 |

FOREIGN PATENT DOCUMENTS

| | | | | |
|---|---|---|---|---|
| JP | 62095565 A | * | 5/1987 | G03G/15/09 |
| JP | 62095566 A | * | 5/1987 | G03G/15/09 |

* cited by examiner

*Primary Examiner*—Robert Beatty
(74) *Attorney, Agent, or Firm*—Lloyd F. Bean, II

(57) ABSTRACT

In a development system including a developer transport adapted for depositing developer material on an imaging surface having an electrostatic latent image thereon, including: a housing defining a chamber storing a supply of developer material comprising soft magnetic toner; a donor member, mounted partially in the chamber and spaced from the imaging surface, for transporting developer on an outer surface thereof to a region opposed from the imaging surface, the donor member having a magnetic assembly having a plurality of poles, a sleeve, enclosing the magnetic assembly, rotating about said magnetic assembly; and a vibrating member positioned in between the magnetic assembly and the sleeve at a predefined position around the donor roll, the vibrating member fluidizing the developer material on the donor member to prevent developer bed freezing, to prevent long-range carrier bead chain formation, and to smooth developer bed height-banding on the donor member before a development zone.

9 Claims, 6 Drawing Sheets

APPARATUS AND METHOD FOR NON-INTERACTIVE MAGNETIC BRUSH DEVELOPMENT

BACKGROUND AND SUMMARY OF THE PRESENT INVENTION

Cross reference is made to the following applications filed concurrently herewith: U.S. patent application Ser. No. 09/995,670, entitled "Apparatus and Method for Non-Interactive Magnetic Brush Development," by Robert J. Meyer et al.; U.S. patent application Ser. No. 09/995,655, entitled "Apparatus and Method for Non-Interactive Magnetic Brush Development," by Robert J. Meyer et al.; U.S. patent application Ser. No. 09/995,628, entitled "Developer Composition for Non-Interactive Magnetic Brush Development," by Robert J. Meyer et al.; U.S. patent application Ser. No. 09/995,658, entitled "Developer Composition for Non-Interactive Magnetic Brush Development," by Robert J. Meyer et al.; U.S. patent application Ser. No. 09/995,632, entitled "Developer Composition for Non-Interactive Magnetic Brush Development," by Robert J. Meyer et al., the disclosure(s) of which are totally incorporated herein.

The invention relates generally to an electrophotographic printing machine and, more particularly, to a development system which includes a magnetic developer roll for transporting soft magnetic developer materials to a development zone; and a magnetic system for generating a magnetic field to reduce developer material bed height in the development zone. To overcome or minimize such problems, the soft magnetic developer materials of the present invention were arrived at after extensive research efforts, and which soft magnetic developer materials result in, for example, sufficient particle charge for transfer and maintain the mobility within the desired range of the particular imaging system employed.

Generally, an electrophotographic printing machine includes a photoconductive member which is charged to a substantially uniform potential to sensitize the surface thereof. The charged portion of the photoconductive member is exposed to an optical light pattern representing the document being produced. This records an electrostatic latent image on the photoconductive member corresponding to the informational areas contained within the document. After the electrostatic latent image is formed on the photoconductive member, the image is developed by bringing a developer material into proximal contact therewith. Typically, the developer material comprises toner particles adhering triboelectrically to carrier granules. The toner particles are attracted to the latent image from the carrier granules and form a powder image on the photoconductive member which is subsequently transferred to a copy sheet. Finally, the copy sheet is heated or otherwise processed to permanently affix the powder image thereto in the desired image-wise configuration.

In the prior art, both interactive and non-interactive development has been accomplished with magnetic brushes. In typical interactive embodiments, the magnetic brush is in the form of a rigid cylindrical sleeve which rotates around a fixed assembly of permanent magnets. In this type of development system, the cylindrical sleeve is usually made of an electrically conductive, non-ferrous material such as aluminum or stainless steel, with its outer surface textured to control developer adhesion. The rotation of the sleeve transports magnetically adhered developer through the development zone where there is direct contact between the developer brush and the imaged surface, and charged toner particles is are stripped from the passing magnetic brush filaments by the electrostatic fields of the image.

These systems employ magnetically hard ferromagnetic material, for example U.S. Pat. No. 4,546,060 discloses an electrographic, two-component dry developer composition comprising charged toner particles and oppositely charged, magnetic carrier particles, which (a) comprise a magnetic material exhibiting "hard" magnetic properties, as characterized by a coercivity of at least 300 gauss and (b) exhibit an induced magnetic moment of at least 20 EMU/gm when in an applied field of 1000 gauss, is disclosed. Magnetically "hard" carrier materials include strontium ferrite and barium ferrite, for example. These carrier materials tend to be electrically insulative as employed in electrophotographic development subsystems. The developer is employed in combination with a magnetic applicator comprising a rotatable magnetic core and an outer, nonmagnetizable shell to develop electrostatic images.

Non-interactive development is most useful in color systems when a given color toner must be deposited on an electrostatic image without disturbing previously applied toner deposits of a different color or cross-contaminating the color toner supplies.

It has been observed in systems employing magnetically hard ferromagnetic material that the magnetic brush height formed by the developer mass in the magnetic fields on the sleeve surface in this type development system is periodic in thickness and statistically noisy as a result of complex carrier bead agglomeration and filament exchange mechanisms that occur during operation. As a result, substantial clearance must be provided in the development gap to avoid photoreceptor interactions through direct physical contact, so that the use of a closely spaced development electrode critical to high fidelity image development is precluded. The effective development electrode is essentially the development sleeve surface in the case of insulative development systems although for conductive magnetic brush systems the effective electrode spacing is significantly reduced.

It has also been found that in the fixed assembly of permanent magnets, the magnetic pole spacing thereof cannot be reduced to an arbitrarily small size because allowance for the thickness of the sleeve and a reasonable mechanical clearance between the sleeve and the rotating magnetic core sets a minimum working range for the magnetic multipole forces required to both hold and tumble the developer blanket on the sleeve. Since the internal pole geometry defining the spatial wavelength of the tumbling component also governs the magnitude of the holding forces for the developer blanket at any given range, there is only one degree of design freedom available to satisfy the opposing system requirements of short spatial wavelength and strong holding force. Reducing the developer blanket mass by supply starvation has been found to result in a sparse brush structure without substantially reducing the brush filament lengths or improving the uneven length distribution.

The above problems with controlling developer bed height are exacerbated when magnetically soft carrier material is employed. Such as disclosed in U.S. Pat. No. 6,143,456; U.S. Pat. No. 4,937,166; U.S. Pat. No. 4,233,387; U.S. Pat. No. 5,505,760; and U.S. Pat. No. 4,345,014 which are hereby incorporated by reference. U.S. Pat. No. 4,345,014 discloses a magnetic brush development apparatus which utilizes a two-component developer of the type described. The magnetic applicator is of the type in which the multiple pole magnetic core rotates to effect movement of the developer to a development zone. The magnetic carrier disclosed in this patent is of the conventional variety in that it comprises relatively "soft" magnetic material (e.g., magnetite, pure iron, ferrite or a form of $Fe_3O_4$) having a magnetic coercivity, Hc, of about 100 gauss or less. Such soft magnetic materials have been preferred heretofore because they inherently exhibit a low magnetic remanance, $B_R$, (e.g., less than about 5 EMU/gm) and a high induced magnetic moment in the field applied by the brush core.

It is desirable to use magnetically soft carrier material because having a low magnetic remanance, soft magnetic carrier particles retain only a small amount of the magnetic moment induced by a magnetic field after being removed from such field; thus, they easily intermix and replenish with toner particles after being used for development. Additionally, conductive carrier material options are significantly broadened for the "soft" magnetic carriers. Also having a relatively high magnetic moment when attracted by the brush core, such materials are readily transported by the rotating brush and are prevented from being picked up by the photoconductive member during development.

Insulating magnetic brush (IMB) development using soft magnetic carriers having an insulating coating suffers from the shortcoming that it produces only relatively low developed mass/unit areas (DMA's). This is due to the buildup of countercharges on the carrier beads as charged toner is developed from them onto the xerographic latent image. Development decreases with time for a given carrier bead until the point at which the attractive field due to the countercharges balances the attractive development field due to the photoreceptor. At this point, the contribution of a particular carrier bead to the development of a latent image ceases.

This problem was partially overcome by the invention of MAZE (magnetically agitated zone) development by Knapp, et. al. In MAZE development carrier bead chains (or bristles) are caused to tumble by changing the direction of the magnets inside the developer roll. As the chains tumble, they expose new carrier beads to the latent image, thereby partially overcoming the low latent images given by IMB development systems. However, even in MAZE development, the amount of dma developed onto the photoreceptor is still only 30–50% of that dictated by the field-collapse (i.e., the CMB) limit. Thus, there is still considerable room for improvement in the dma's produced by (insulating) MAZE development systems.

Conductive magnetic brush (CMB) development systems allow the neutralization of the countercharges on carrier beads via conduction through the carrier bead chains. Thus, CMB development systems don't suffer from the low dma problems of IMB systems. Indeed, applicants have found that CMB systems can develop to the field collapse limiting dma's if sufficient numbers of development rolls are used. This may require 5–6, or more, rolls however. This is because of depletion of available toner from the developer bed near the ends of the carrier bead chain where in contact the photoreceptor.

A solution to this problem would be to use conductive carrier in MAZE. In this case we would expect that by tumbling the carrier bead chains so that 5 or more different carrier bead chain transitions within the development zone region in close proximity to the P/R we would be able to achieve the same dma's as would be obtained from 5 or more development rolls. In effect this would overcome the supply limitations of a single development roll and reduce the effects of electrostatic field collapse. It would also enable higher process speed since toner replenishment at the surface of the mag brush roll would be improved.

While this approach sounds obvious and promising, conductive MAZE and TurboMAZE experiments have not proven effective. Two problems have been found with the conductive carriers, that are also magnetically "soft", in MAZE development: First, the carrier on the developer roll tends to form bands, so that some areas of the roll have too thick a bed of developer (i.e., carrier beads plus toner) while other areas have none. Secondly, the carrier on the developer roll tends to solidify and form an almost solid mass, precluding rotation of the developer roll, carrier bead chain rotation, and also replenishment of carrier on the development roll from carrier in the sump.

The following disclosures may be relevant to the present invention:

U.S. Pat. No. 5,890,041 discloses a development system for developing an image with developer material including a housing containing developer material; and a magnetic roll for transporting the developer material from the housing to the image, the magnetic roll including an magnetic core and a cylindrical sleeve enclosing and rotating about the magnetic core, the sleeve having a thickness between 0.001 to 0.006 inches.

U.S. Pat. No. 5,946,534 discloses a method for creating a densely packed, stable [non-bead chain forming] monolayer developer bed in the TurboMaze configuration. This configuration is achieved by designing carrier beads such that the bead to bead interaction is significantly less than the bead to magnetic substrate interaction by encapsulating a hard ferrite carrier bead in a nonmagnetic shell.

SUMMARY OF THE INVENTION

The present invention obviates the problems noted above by utilizing a development system including a developer transport adapted for depositing developer material on an imaging surface having an electrostatic latent image thereon, comprising: a housing defining a chamber storing a supply of developer material comprising soft magnetic toner; a donor member, mounted partially in said chamber and spaced from the imaging surface, for transporting developer on an outer surface thereof to a region opposed from the imaging surface, said donor member having a magnetic assembly having a plurality of poles, a sleeve, enclosing said magnetic assembly, rotating about said magnetic assembly; and a vibrating member positioned in between said donor roll and said sleeve at a predefined position around said donor roll, said vibrating member fluidizing said developer material on said donor member to prevent developer bed freezing, to prevent long-range carrier bead chain formation, and to smooth developer bed height-banding on said donor member before a development zone.

DETAILED DESCRIPTION

Figure 1:
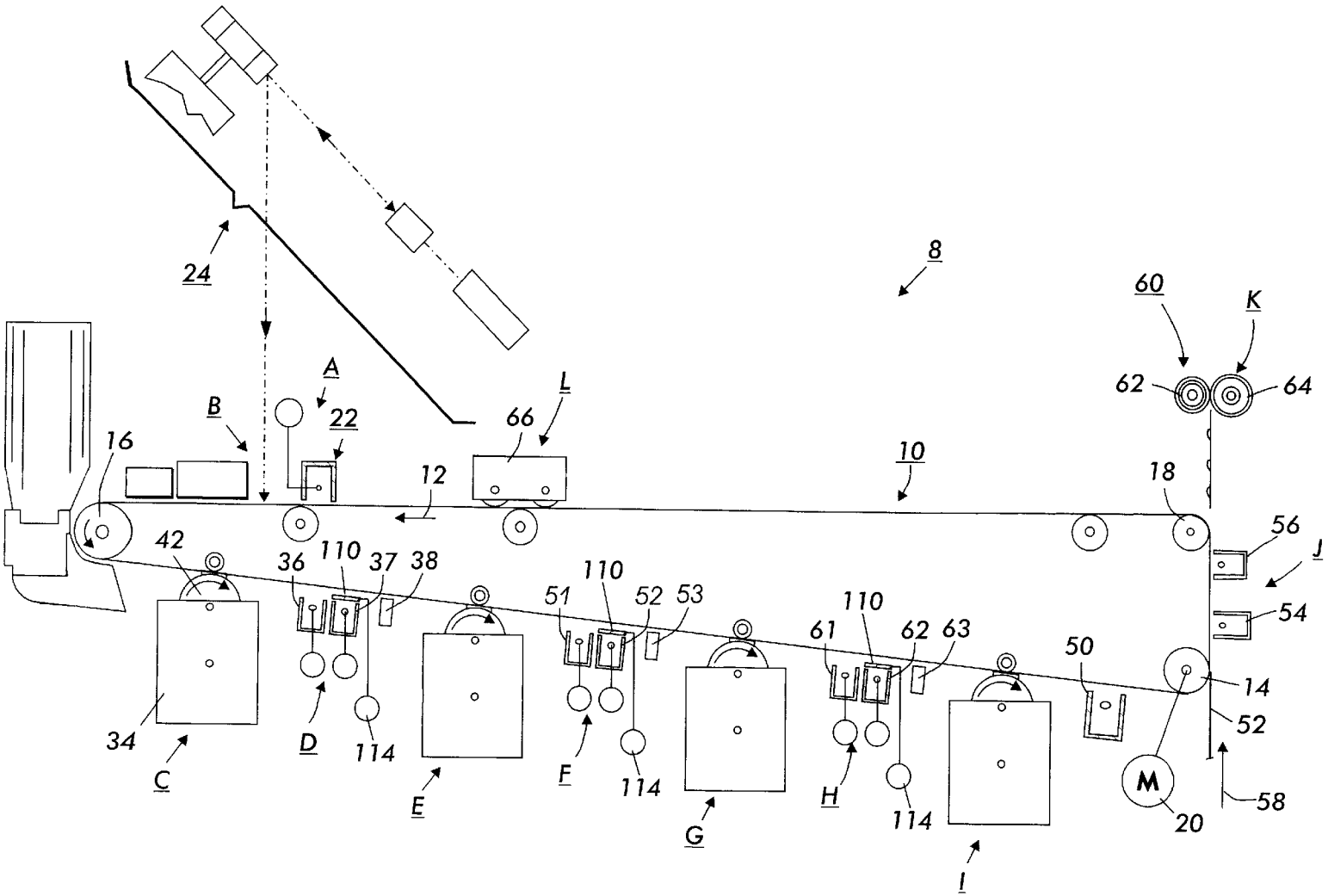
FIG. 1 is a schematic elevational view of an illustrative electrophotographic printing or imaging machine or apparatus incorporating a development apparatus having the features of the present invention therein.

First focusing on the "physics of chain motion", carrier bead chain rotation, and indicate the physical basis for the observed differences in behavior between conductive mag brush (CMB) and insulative mag brush (IMB) MAZE development. The essence of the difference lies in the magnetic properties of the carriers used: "hard" (i.e. ferromagnetic and have a permanent magnetic moment.magnetic) carriers tend to be electrically insulative. Most typically available conductive carrier materials tend to be magnetically "soft". Magnetically hard and soft carrier have very different magnetic moments as a function of chain length, and as a consequence chains of hard carrier beads have a self-regulated growth which limits them to relatively short chain lengths. Magnetically soft carrier beads have no such growth limitations thereby grow without limit. When such long chains grow and rotate, they tend to entangle, leading either to freezing of the fluidized developer bed, or to runaway chain growth, resulting in developer banding on the developer sleeve. In either case normal developer roll function ceases in MAZE with soft carrier.

Chaining phenomena can drastically change the mechanical and flow properties of powders (in this case developer). For example, the freezing of an electrofluidized bed appears to be related to the chaining of powder particles [1]. This is not surprising, since the elastic moduli of adhesive networks undergo a percolation transition [2–4] corresponding to the chaining of adhesive bonds. When percolating chains or clusters exceed a critical size, macroscopic bulk and shear moduli rapidly increase, and solid aggregates form [5]. Thus, we look at the magnetic chaining behavior to understand and cure problems 1 and 2 above. First, however, lets consider carrier core materials in current use.

Carrier core materials applied for TurboMAZE have most commonly been strontium ferrite particles in the 30 micron nominal diameter range. These materials have been acquired from Powdertech (Indiana) and FDK (Japan). The strontium ferrite core tends to be inherently quite insulative, (thus TurboMAZE operates in the IMB regime). These varieties of insulative carriers are magnetically hard, and can be (and are in practice) rendered permanently magnetized by introducing them to a strong magnetic field—typically on the order of 3 Kgauss.

In recent times conductive cores have been produced by doping the molecular structure. Additionally carrier coatings (such as XP454—a carbon black containing material) have been applied to impart conductivity. Conductive carriers have been described and produced in recent times which are also magnetically hard. However, the prevalent conductive carrier commercially available is magnetically soft.

Hard carrier beads form chains that are self-limiting in length under rotation. Thus, they do not suffer from the problems associated with runaway chain growth, such as entangling (resulting in freezing of the developer bed) or runaway accretion (resulting in banding of developer on the development sleeve). Soft carrier does not have such a self-limiting feature inherent in the physics of chain rotation. This results in chain entanglement or runaway accretion. As a result, chain length must be artificially limited for soft carrier, via the present invention.

The differences in rotational behavior of hard and soft magnetic particles can be understood by examining the behavior of $\mu_N$ in the two cases. This is in general a difficult analysis since the dependence of the magnetic dipole moment, $\mu_N$, on the chain length or N is not well understood. However, there are a couple of limiting cases for which we can give analytic results, and that make clear the nature of the technical difficulties with MAZE using soft magnetic carrier.

The first case to consider is hard, or permanently magnetized, carrier. This carrier is ferromagnetic, and the magnetic field in the domains is permanently aligned in one direction. The name hard results from the alloying of soft iron (which doesn't hold a permanent magnetic field well when an external aligning field is withdrawn) with other metals which results in a harder alloy. This alloying process also results in a material able to hold a permanent magnetic field without the external field. Let's assume that for hard magnetic carrier the magnetic dipole moment of the carrier is permanent, and has a constant value (independent of applied magnetic field) $\mu_H$. Then the dipole moment of a chain of these particles can be shown to have the value:

$$\mu_N = N\mu_H. \tag{4}$$

Thus, the coefficient $\mu_N/I_N$ for hard carrier varies as $$\mu_N/I_N = (\mu_H/mr_c^2)N/\{(2/3)N(N+1)(2N+1)-2N(N+1)+N\}. \tag{5}$$

For large N this coefficient will vary as $1/N^2$. However, the function dies even more rapidly for small N.

The coefficient $\mu_N/I_N$ is an order of magnitude smaller for N=6 than it was for N=2. By the time the chain length has reached 19 particles the coefficient $\mu_N/I_N$ is only 1% of that for N=2.

Correspondingly, the time response of the chain to perturbations which may cause it to lag behind (or lead) the rotational motion of the magnetic field becomes slower as the chain length increases. Analysis of Eq. (2) shows that the time, $\tau$, required for the chain to return to the direction of the field if it is pushed away (such as by interactions with other chains) is given approximately by:

$$\tau = \pi\sqrt{[I_N/(B\mu_N)]}. \tag{6}$$

The response time of the chain is inversely proportional to the square root of the coefficient $\mu_N/I_N$. As the chain grows longer the response time to correct for a perturbation grows longer. When $\tau$ becomes larger that half the rotational period of the magnetic field, the chain stability in the field will break down, limiting chain length. Thus, for stability we require:

$$\sqrt{[B\mu_N/I_N]} \geq \omega \tag{7}$$

The equality in the above equation gives the limiting chain length through the dependence of $\mu_N/I_N$ on N. Eq. (7) can be utilized in three ways: (i) to evaluate how long a chain of hard (or soft) carriers is stable at a particular field rotation rate (magnetic field switching rate) for a given magnetic field; and (ii) to evaluate the magnetic field, B, required to stabilize a chain of length N at a given rotational velocity $\omega$, and (iii) to determine the upper limit of the magnetic brush velocity via $v_{max}=d/\tau$, where d is the distance between like poles in the alternating magnet pole series. This also limits the process velocity since the magnetic brush velocity is typically one to three times the process or photoreceptor velocity. (Note, Eq.(6) and (7) hold not only for the hard carrier case, discussed above, but also for the $\kappa_m \rightarrow \infty$ soft carrier case, discussed below, and for the general $\kappa_m$ soft carrier case which must be solved numerically.)

The effect of this rapid decrease in $\mu_N/I_N$ with increasing chain length is to limit the length of hard carrier chains that can be rotated in a rotating magnetic field. Thus, for hard carrier the chain length is self-limiting. As the chain rotates and more carriers come into contact with and add on to the end of the chain, the ability of the chain to keep up with the rotating field decreases. A point is reached at which the inertial (and also friction) forces due to neighbors surpasses the force exerted by the rotating field on the chain. At this point, the chain will be unable to keep up with the rotating field, leading to the dissolution of the chain. For hard carrier, a long unstable chain's particles will be available for scavenging by neighboring shorter stable chains that are in the process of growing.

The case of (magnetically) soft carrier is somewhat different. This case is harder to compute the dependence of magnetic moment of the chain on chain length. We borrow a result from electrostatics, where the dipole moment, ρ, of a chain of perfect conductors in an electric field, $E_o$, has been found to be approximately given by [6]:

$$P_N=(4/3)\pi\epsilon_o E_o r_c^3[(2\ln(2)-1)N^3+(6-6\ln(2))N^2+(4\ln(2)-8)N+12(N-1)\zeta(3)], \quad (8)$$

where ζ is the Riemann zeta function, ζ (3)=1.20205, $r_c$ is the radius of the particles in the chain, and $E_o$ is the applied electric field. The result given in Eq. (8) is valid for infinite relative dielectric constant of the spheres, κ. Eq. (8) has been numerically verified for chains 2–30 particles long by finite element analyses, with an average error of approximately 2%.

This calculation can be carried over to magnetic systems. Detailed analysis shows that the analog in magnetic systems is not to superconducting spheres, as might at first guess be expected, but rather to ferromagnetic spheres, which is the desired case. Eq. (8) in the magnetic case becomes:

$$\mu_N=((4/3)\pi B_o r_c^3/\mu_o)[(2\ln(2)-1)N^3+(6-6\ln(2))N^2+(4\ln(2)-8)N+12(N-1)\zeta(3)], \quad (9)$$

where $B_o$ is the applied magnetic field and $\mu_o$ is the magnetic permeability of free space. This result is valid in the limit of infinite relative magnetic permeability, $\kappa_m \rightarrow \infty$. Finite element calculations verify Eq. (9) to within 1–2% for chains up to 30 particles long. For finite $\kappa_m$ the dipole moment of soft carrier bead chains must be evaluated numerically. This can be done using commercial computer programs such as PDEase.

In the soft magnetic carrier analysis we find:

$$\mu_N/I_N=((4/3)\pi B r_c/\mu_o m)[(2\ln(2)-1)N^3+(6-6\ln(2))N^2+(4\ln(2)-8)N+12(N-1)\zeta(3)]/\{(2/3)N(N+1)(2N+1)-2N(N+1)+N\}. \quad (10)$$

This function behaves quite differently than that for hard carrier, given by Eq. (5). In the large N limit the N-dependent terms in the ratio $\mu_N/I_N$ approach a value of approximately 20% of the N=2 value. Thus, for soft carrier long chains may behave like chains no longer than N=4 chains of hard carrier. In effect, soft carrier chains are not limited in their ability to rotate as they grow long: there is no self-limiting feature as there is for hard carrier. (Actually, this is only approximately true, since the chains need to push other carrier out of the way as they rotate, which acts to limit their freedom, but this is a higher order effect, and requires a more detailed model, or numerical simulation.)

There are a couple of possible consequences of long chain growth for soft carrier. One is that chains can go through unlimited carrier accretion. It can be shown that these chains will tend to grow exponentially in length with time, given approximately by:

$$N(t)=2e^{p\omega t}, \quad (11)$$

where p is the packing fraction of carrier, probably on the order of 0.5, and ω is the angular velocity of the rotating field, in this case due to magnetic field polarity reversals. As we see, the chains grow at a rapid rate as they rotate. Thus, it is important to eliminate tumbling of the chains except in the development nip where it is necessary to provide toner replenishment for latent image development.

The runaway chain accretion described by Eq. (11) is most likely to occur when the friction coefficient between the chain and the developer sleeve is relatively low, enabling long range developer motion on the sleeve. From a macroscopic point of view, unlimited chain growth means that carrier from a surrounding area will be sucked into a region until there is no more to be had. For soft carrier, chains are recruited or scavenged by longer chains having stronger fields at their ends. This results in the familiar banding of developer on the sleeve.

When the friction coefficient between the chains and the sleeve are higher than a critical value the long range chain motion described above will not be possible. In this case chains stay more or less in place. Chains will either grow by scavenging carrier beads from shorter chains and continuing to rotate, or when the chains are sufficiently long they will entangle, forming a network that results in freezing of the bed. This bed freezing is due to the extension of intra-chain particle-particle bonds over a distance that exceeds the percolation threshold length. The developer acts as a solid, making rotation through the nip and reloading at the sump difficult or impossible. Under either of these circumstances the developer housing can no longer function.

Since there is no self-limiting mechanism for chain length for soft magnetic carrier, in order to make such carrier function in MAZE, it is necessary to restrict chain length to less than the percolation length by other means.

For soft carrier the natural question is how long the chain can be before solidification of the fluidized carrier bed occurs. We naturally want to regulate the length of the carrier bead chains to be less than this critical length. To some extent this answer is chain growth dependent. As the chains get longer, their field will get stronger and they will be able to pull in carrier from further away. (The is true for infinitely polarizable carrier; finite polarizability will tend to limit this). However, the particle—particle magnetic force dies as $r^{-7}$. As a result, the force doesn't reach far.

Now referring to FIG. 1, there is shown an illustrative electrophotographic machine having incorporated therein the development apparatus of the present invention. An electrophotographic printing machine 8 creates a color image in a single pass through the machine and incorporates the features of the present invention. The printing machine 8 uses a charge retentive surface in the form of an Active Matrix (AMAT) photoreceptor belt 10 which travels sequentially through various process stations in the direction indicated by the arrow 12. Belt travel is brought about by mounting the belt about a drive roller 14 and two tension rollers 16 and 18 and then rotating the drive roller 14 via a drive motor 20.

As the photoreceptor belt moves, each part of it passes through each of the subsequently described process stations.

For convenience, a single section of the photoreceptor belt, referred to as the image area, is identified. The image area is that part of the photoreceptor belt which is to receive the toner powder images which, after being transferred to a substrate, produce the final image. While the photoreceptor belt may have numerous image areas, since each image area is processed in the same way, a description of the typical processing of one image area suffices to fully explain the operation of the printing machine.

As the photoreceptor belt 10 moves, the image area passes through a charging station A. At charging station A, a corona generating device, indicated generally by the reference numeral 22, charges the image area to a relatively high and substantially uniform potential.

After passing through the charging station A, the now charged image area passes through a first exposure station B. At exposure station B, the charged image area is exposed to light which illuminates the image area with a light representation of a first color (say black) image. That light representation discharges some parts of the image area so as to create an electrostatic latent image. While the illustrated embodiment uses a laser based output scanning device 24 as a light source, it is to be understood that other light sources, for example an LED printbar, can also be used with the principles of the present invention.

After passing through the first exposure station B, the now exposed image area passes through a first development station C which is identical in structure with development system E, G, and I. The first development station C deposits a first color, say black, of negatively charged toner 31 onto the image area. That toner is attracted to the less negative sections of the image area and repelled by the more negative sections. The result is a first toner powder image on the image area.

For the first development station C, development system 34 includes a donor roll 42. Donor roll 42 is mounted, at least partially, in the chamber of developer housing 44. The chamber in developer housing 44 stores a supply of developer (toner) material that develops the image. Toner (which generally represents any color of toner) adheres to the illuminated image area.

After passing through the first development station C, the now exposed and toned image area passes to a first recharging station D. The recharging station D is comprised of two corona recharging devices, a first recharging device 36 and a second recharging device 37, which act together to recharge the voltage levels of both the toned and untoned parts of the image area to a substantially uniform level. It is to be understood that power supplies are coupled to the first and second recharging devices 36 and 37, and to any grid or other voltage control surface associated therewith, as required so that the necessary electrical inputs are available for the recharging devices to accomplish their task.

After being recharged at the first recharging station D, the now substantially uniformly charged image area with its first toner powder image passes to a second exposure station 38. Except for the fact that the second exposure station illuminates the image area with a light representation of a second color image (say yellow) to create a second electrostatic latent image, the second exposure station 38 is the same as the first exposure station B.

The image area then passes to a second development station E. Except for the fact that the second development station E contains a toner 40 which is of a different color (yellow) than the toner (black) in the first development station C, the second development station is beneficially the same as the first development station. Since the toner is attracted to the less negative parts of the image area and repelled by the more negative parts, after passing through the second development station E the image area has first and second toner powder images which may overlap.

The image area then passes to a second recharging station F. The second recharging station F has first and second recharging devices, the devices 51 and 52, respectively, which operate similar to the recharging devices 36 and 37. Briefly, the first corona recharge device 51 overcharges the image areas to a greater absolute potential than that ultimately desired (say −700 volts) and the second corona recharging device, comprised of coronodes having AC potentials, neutralizes that potential to that ultimately desired.

The now recharged image area then passes through a third exposure station 53. Except for the fact that the third exposure station illuminates the image area with a light representation of a third color image (say magenta) so as to create a third electrostatic latent image, the third exposure station 38 is the same as the first and second exposure stations B and 38. The third electrostatic latent image is then developed using a third color of toner (magenta) contained in a third development station G.

The now recharged image area then passes through a third recharging station H. The third recharging station includes a pair of corona recharge devices 61 and 62 which adjust the voltage level of both the toned and untoned parts of the image area to a substantially uniform level in a manner similar to the corona recharging devices 36 and 37 and recharging devices 51 and 52.

After passing through the third recharging station the now recharged image area then passes through a fourth exposure station 63. Except for the fact that the fourth exposure station illuminates the image area with a light representation of a fourth color image (say cyan) so as to create a fourth electrostatic latent image, the fourth exposure station 63 is the same as the first, second, and third exposure stations, the exposure stations B, 38, and 53, respectively. The fourth electrostatic latent image is then developed using a fourth color toner (cyan) contained in a fourth development station I.

To condition the toner for effective transfer to a substrate, the image area then passes to a pretransfer corotron member 50 which delivers corona charge to ensure that the toner particles are of the required charge level so as to ensure proper subsequent transfer.

After passing the corotron member 50, the four toner powder images are transferred from the image area onto a support sheet 52 at transfer station J. It is to be understood that the support sheet is advanced to the transfer station in the direction 58 by a conventional sheet feeding apparatus which is not shown. The transfer station J includes a transfer corona device 54 which sprays positive ions onto the backside of sheet 52. This causes the negatively charged toner powder images to move onto the support sheet 52. The transfer station J also includes a detack corona device 56 which facilitates the removal of the support sheet 52 from the printing machine 8.

After transfer, the support sheet 52 moves onto a conveyor (not shown) which advances that sheet to a fusing station K. The fusing station K includes a fuser assembly, indicated generally by the reference numeral 60, which permanently affixes the transferred powder image to the support sheet 52. Preferably, the fuser assembly 60 includes a heated fuser roller 62 and a backup or pressure roller 64. When the support sheet 52 passes between the fuser roller 62 and the backup roller 64 the toner powder is permanently affixed to the sheet support 52. After fusing, a chute, not shown, guides the support sheets 52 to a catch tray, also not shown, for removal by an operator.

After the support sheet 52 has separated from the photoreceptor belt 10, residual toner particles on the image area are removed at cleaning station L via a cleaning brush contained in a housing 66. The image area is then ready to begin a new marking cycle.

The various machine functions described above are generally managed and regulated by a controller which provides electrical command signals for controlling the operations described above.

Figure 2:
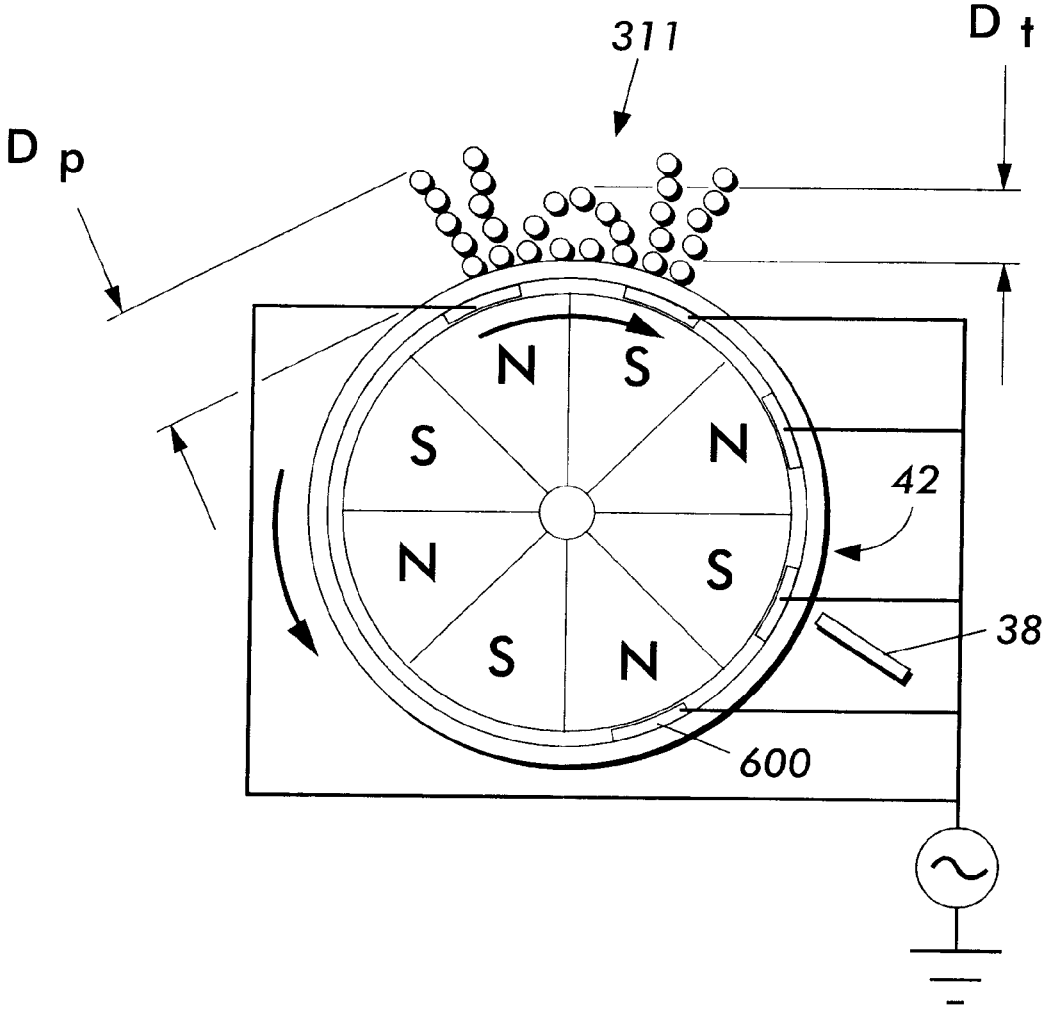
FIG. 2 is a schematic view showing the donor roll illustrates variations in the developer bed height of development apparatus used in the FIG. 3 printing machine.
Figure 3:
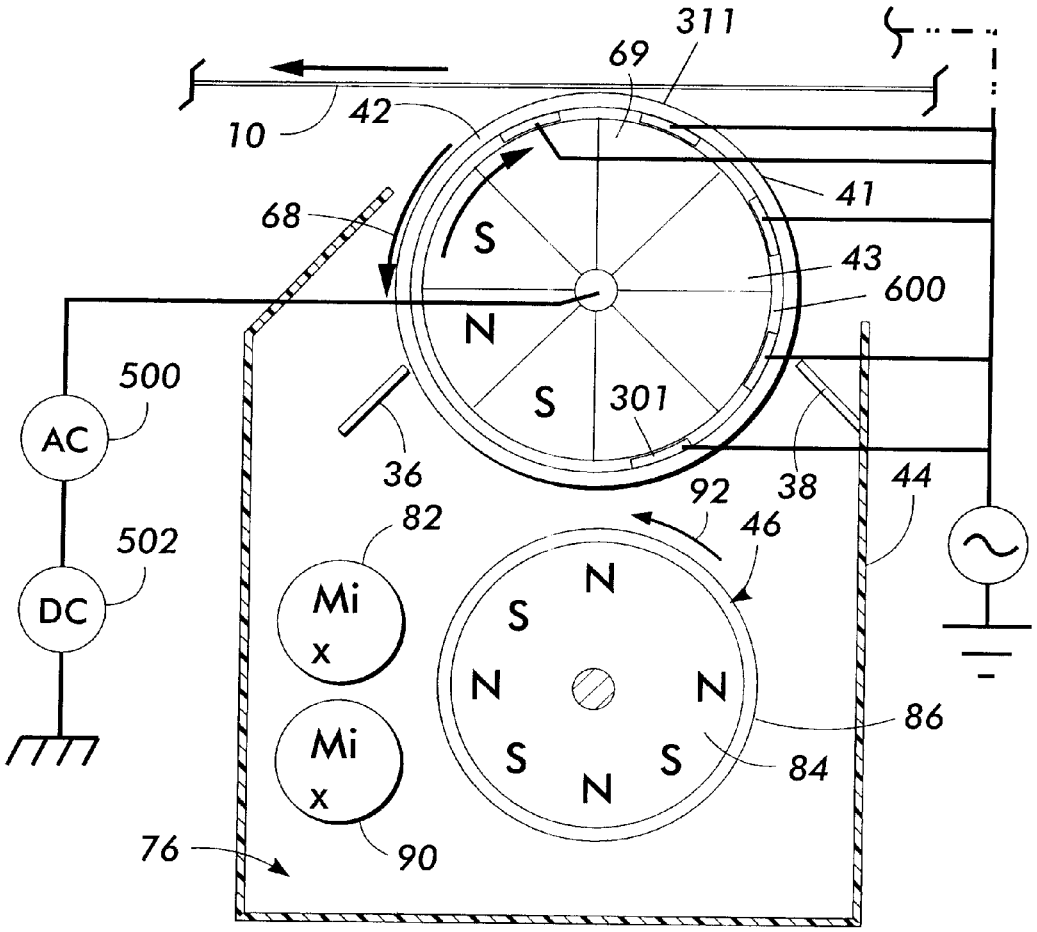
FIG. 3 is a schematic view showing incorporating a development apparatus having the features of the present invention therein.

Focusing on the development process, developer material is magnetically attracted toward the magnetic assembly of donor roller forming brush filaments corresponding to the magnetic field lines present above the surface of the sleeve. It has been observed that carrier beads tend to align themselves into chains that extend normal to the development roll surface over pole faces and lay down parallel to the roll surface between pole faces where the magnetic field direction is tangent to the roll surface. The net result is that the effective developer bed height varies from a maximum over pole face areas to a minimum over the pole transition areas. This effect is illustrated in FIG. 2. Rotation of the magnetic assembly causes the developer material, to collectively tumble and flow due to the response of the permanently magnetic carrier particles to the changes in magnetic field direction and magnitude caused by the internal rotating magnetic roll. This flow is in a direction "with" the photoreceptor belt 10 in the arrangement depicted in FIG. 4. Magnetic agitation of the carrier which serves to reduce adhesion of the toner particles to the carrier beads is provided by this rotating harmonic multipole magnetic roll within the development roll surface on which the developer material walks.

In the desired noninteractive development mode carrier beads must be prevented from touching the photoreceptor surface or any previously deposited toner layers on the photoreceptor. This is to prevent disturbance of the previously developed toner image patterns that are being combined on the photoreceptor surface to create composite color images. The variation in developer bed height illustrated in FIG. 2 forces the minimum spacing between the photoreceptor and the developer bed surface to be determined by the bed height at the pole areas where the bed height $D_p$ is largest in order to prevent interaction. The average spacing achieved in this manner is then determined by the average bed height which will be greater than the minimum bed height—i.e. $(D_p+D_t)/2>D_t$.

The present invention prevents bead chain growth and minimizes the peak developer bed height, $D_p$, and reduces variation in developer bed height that occurs within the development nip to thereby enable a reduction in the effective development electrode spacing to enhance image quality.

Figure 4:
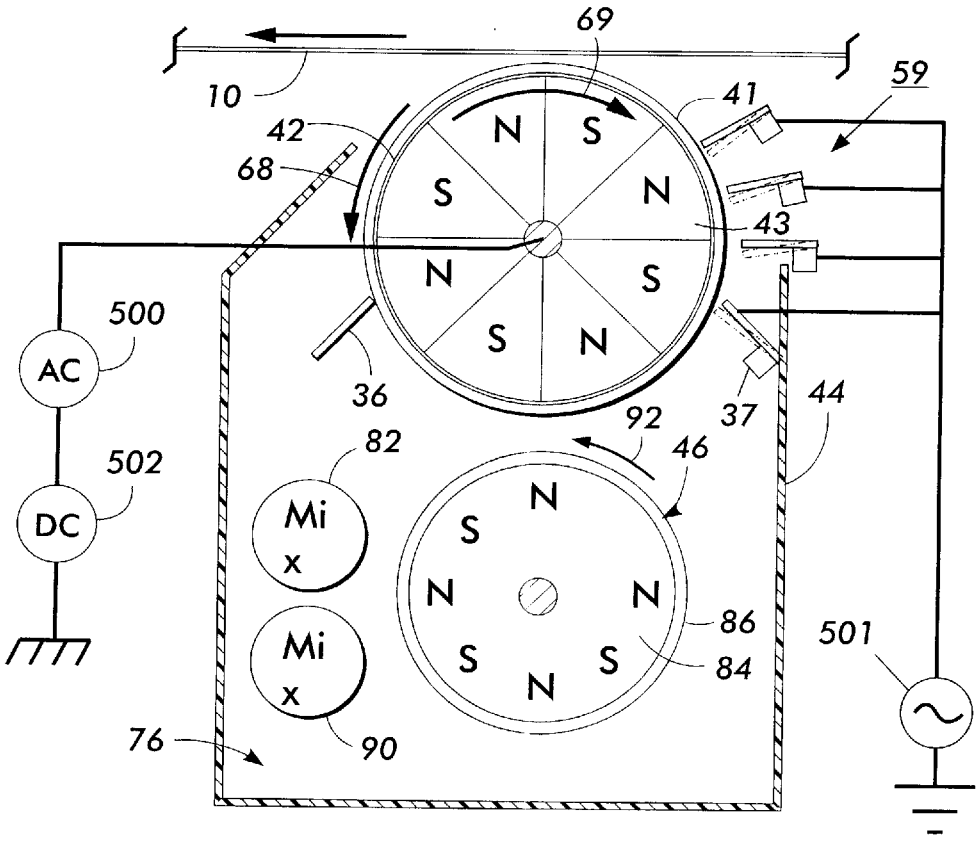
FIG. 4 is another embodiment of the present invention.

Referring now to FIG. 4 in greater detail, development system 34 includes a housing 44 defining a chamber 76 for storing a supply of developer material therein. Donor roll 42 comprises an interior rotatable harmonic multipole magnetic assembly 43 and an outer sleeve 41. The sleeve can be rotated in either the "with" or "against" direction relative to the direction of motion of the photoreceptor belt 10. Similarly, the magnetic assembly can be rotated in either the "with" or "against" direction relative to the direction of motion of the sleeve 41. Preferably, sleeve has a thickness about 100 to 350 microns and magnetic assembly has a pole spacing from 1 mm to 1 cm. The relative rotation is between 200 to 2000 rpm. It is preferred to adjust the parameters of pole spacing, sleeve thickness and relative rotation to achieve 6–10 flips of bead chains [accomplished by sliding the bead chain from being over one type of magnetic pole(e.g., N) within the development sleeve to being over the opposite type of magnetic pole (e.g., S)] in the development zone 311 to attain a sufficient toner supply to develop to field collapse.

In FIG. 4, the sleeve is shown rotating in the direction of arrow 68 that is the "with" direction of the belt and magnetic assembly is rotated in the direction of arrow 69. Blade 38 is placed in near contact with the rotating donor roll 42 to trim the height of the developer bed. Blade 36 is placed in contact with the rotating donor roll 42 to continuously remove developer from the roll for return to the developer chamber 76.

A DC and AC bias is applied to sleeve 41 by power supply 500, which serves as the development electrode, to effect the necessary development bias with respect to the image potentials present on the photoreceptor .

Piezoelectric elements 301 are positioned between magnetic assembly 43 and sleeve 41. Preferably, piezoelectric elements are positioned from the reload area between donor roller 42 and magnetic roller 46 through the development zone between donor roller 42 and belt 10. Piezoelectric elements 301 apply vibrational motion to sleeve 41 between the reload area and the development zone which causes motion of the carrier which inhibits bead chain growth. Preferably about 1 to 100 KHz frequency is applied to piezoelectric elements to impart a vibrational energy on the sleeve surface from 1 to 100 microns of amplitude.

Magnetic roller 46 advances a constant quantity of developer onto donor roll 42. This ensures that donor roller 42 provides a constant amount of developer with an appropriate toner concentration into the development zone. Magnetic roller 46 includes a non-magnetic tubular member 86 (not shown), made preferably from aluminum and having the exterior circumferential surface thereof roughened. An elongated magnet 84 is positioned interiorly of and spaced from the tubular member. The magnet is mounted stationary and includes magnetized regions appropriate for magnetic pick up of the developer material from the developer chamber 76 and a nonmagnetized zone for developer material drop off. The tubular member rotates in the direction of arrow 92 to advance the developer material adhering thereto into a loading zone formed between magnetic roller 46 and donor roller 42. In the loading zone, developer material is preferentially magnetically attracted from the magnetic roller onto the donor roller. Augers 82 and 90 are mounted rotatably in chamber 76 to mix and transport developer material. The augers have blades extending spirally outwardly from a shaft. The blades are designed to advance the developer material in a direction substantially parallel to the longitudinal axis of the shaft.

The present invention utilizes several method in combination to reduce bead growth. Another method is to employed a series of trim bars around the donor roller as shown in FIG. 4. The trim bars have the effect of constantly limiting chain length. Trim bars are positioned from the reload area to the development zone. Each trim bar is space in declinding trim height from the reload area to the development zone, for example 1 mm to 0.5 mm.

Applicants have found that in addition to using a series of trim bars; imparting vibrational motion to the bead chain on the donor roller can further serve to limit bead chain length. This can be accomplished by incorporating by piezoelectric element 37 into the trim bars. Preferably trims bars are positioned between the reload area and the development zone. The trim bars are spaced between 100 microns to 1 mm from the donor member. Piezoelectric element is placed at the base of the trim bar and causes the trim bar preferably to deflect 1 to 100 microns in vibrational amplitude at a frequency of 1 to 100 kHz. Preferably, piezoelectric element is made from a piezoelectric ceramic material.

The present invention can employ magnetic carrier of the conventional variety in that it comprises relatively "soft" magnetic material (e.g., magnetite, pure iron, ferrite or a form of $Fe_3O_4$) having a magnetic coercivity, Hc, of about 100 gauss or less. Such soft magnetic materials have been preferred heretofore because they inherently exhibit a low magnetic remanance, $B_R$, (e.g., less than about 20 EMU/gm but preferably less than 5 EMU/gm) in a high induced magnetic moment in the field applied by the brush core. Commonly applied examples of soft carrier material include copper zinc ferrite (CuZn ferrites) or nickel zinc (NiZn ferrites) core materials. Other materials which may be classified as soft magnetic carriers can include magnetite, pure iron, or ferrite (Fe3O4 for example). These materials will exhibit reduced magnetic saturation and lower coercivity values than that of the hard magnetic materials.

Alternatively, the present invention can employ modified carrier materials that limit chain growth. The tendency of magnetically soft carrier beads to chain can be decreased by decreasing the magnetic interaction between carrier beads. This can be accomplished in several ways. The first is by decreasing the relative magnetic permeability $\kappa_m$ of the individual carrier beads. We do this by combining the ferromagnetic core material having a high $\kappa_m$ with ferromagnetic core material having a lower $\kappa_m$, or with nonferromagnetic material. Preferably the relative magnetic permeability $\kappa_m$ of the alloy is between 20 and 80.

For example, a ferromagnetic core material having a high $\kappa_m$ such as hard magnetic carriers include stontium or barium ferrites in the form MOFe2O3 (where M=Ba or Sr for hard magnetic materials), (for example SrFe12O19). These hard carrier materials can exhibit a coercivity of 300 gauss or greater with a magnetic moment of order 20 to 100 EMU/gm in an applied field of approximately 1000 gauss at presented at the developer roll surface. Other materials commonly applied to provide hard magnetic properties include the alnico (aluminum-nickel-cobalt) alloys, rare-earth materials such as samarium-cobalt (Sm—Co), neodymium-iron-boron alloys (Nd—Fe—B). Core material having a lower $\kappa_m$ such as copper zinc ferrite (CuZn ferrites) or nickel zinc ferrite (NiZn ferrites) core materials can be applied as soft magnetic carriers. Other soft magnetic materials to be considered include nickel-iron alloys, MOFe2O3 (where M=$Fe^{2+}$, $Mn^{2+}$, $Ni^{2+}$, or $Zn^{2+}$for soft magnetic materials), and iron-silicon alloys. Many of these materials may be readily blended and/or alloyed to provide intermediate magnetic properties. Applied pre-magnetizing fields can also be varied to render the carrier core materials to provide different properties in the magnetic field presented by the developer roll magnetics.

After the process of combining so as disclosed in the U.S. Pat. No. 5,914,209, the disclosure of which is totally incorporated by reference, there is illustrated a process of preparing MICR toners using a combination of hard and soft magnetites and lubricating wax in the formulation and melt mixing with a resin followed by jetting and classifying the blend to provide toner compositions. Desired combined carrier may have a particle sizes ranging from 5 to 50 micron diameters typically. These magnetic materials may be magnetized prior to application in the developer housing by exposing them to a sufficiently high magnetic field, of from 0 to 10,000 gauss (to effect orientation of the magnetic domains) to achieve the desired magnetic moment of the particles. Magnetic properties of these carriers can be substantially altered by chemical makeup and doping of the parent composition.

Figure 5:
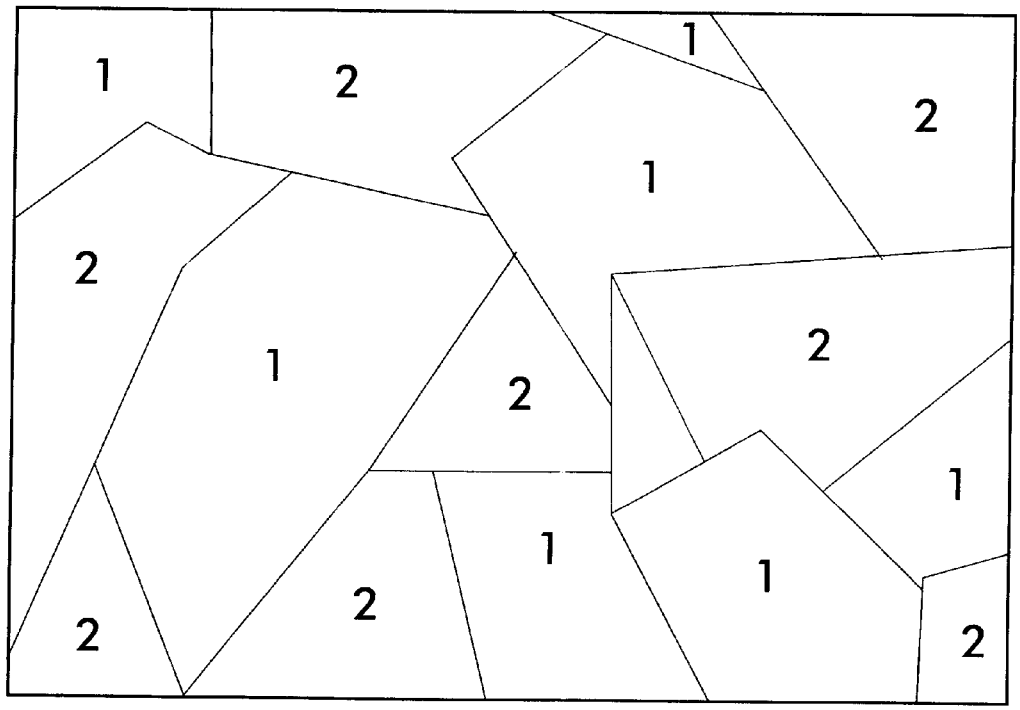
FIG. 5 is a theoretical microgeometry of a developer composition.

In determining what materials to employ to achieve the desired relative magnetic permeability $\kappa_m$ a physical model of the effective average relative permeability of such an alloy can be employed; one such model was proposed by Bruggeman (1935). (Actually, Bruggeman modeled a dielectric system. It has been shown that this model also describes a magnetic system [Torquato(1991)].) The Bruggeman model is called an effective medium theory (hereafter EMT). It gives a prescription for the properties of the average system in terms of the properties of the individual constituents of the alloy, and the volume fractions of each of the constituents. There are a number of different EMT's available in the physics literature. Each EMT describes the effective properties of a system with a different microgeometry. The Bruggeman EMT is appropriate for the microgeometry shown in FIG. 5. This is an aggregate structure in which type 1 and type 2 materials enter on an equal footing to form a space-filling structure. An element of volume has a probability $f_1$ of being material 1, and a probability $f_2=1-f_1$ of being material 2. The Bruggeman model treats the host and inclusion on an equal basis, and the equations are symmetrical with respect to interchange of indiced 1 and 2 (This is not true in all effective medium theories and corresponding microgeometries.)

The effective relative permeability in the Bruggeman EMT is obtained by solving the quadratic equation for $\kappa_{Br}$:

$$\{3f_1/(2+\kappa_1/\kappa_{Br})\}+\{3(1-f_1)/(2+\kappa_2/\kappa_{Br})\}=1 \quad (12),$$

where $\kappa_1$ and $\kappa_2$ are the relative permeabilities of the high and low permeability constituents of the alloy. Eq. (12) reduces to [Landauer (1978)]:

$$\kappa_{Br}=(1/4)[y(y+8\kappa_1\kappa_2)^{1/2}], \quad (13)$$

where $$\gamma=(3f_2-1)\kappa_2+(3f_1-1)\kappa_1. \quad (14)$$

Figure 6:
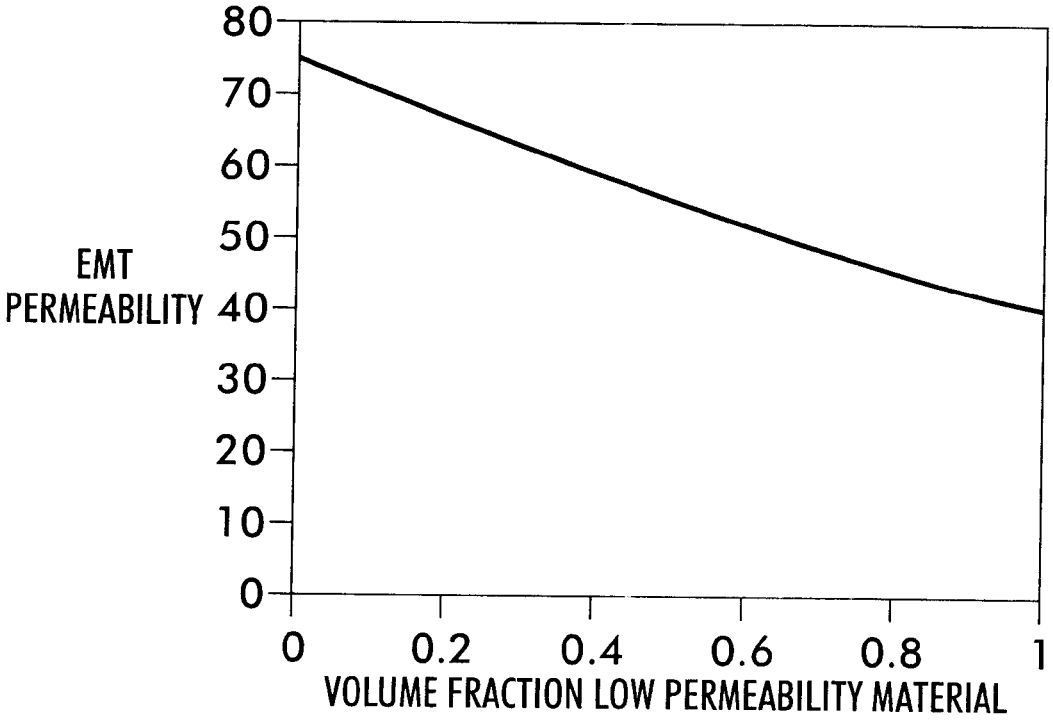
FIG. 6 is an example Bruggeman effective medium theory (EMT) calculation.

An example Bruggeman EMT calculation is shown in FIG. 6 for allows of varying volume fractions of the low relative permeability constituent $0<f_1<1$. The example shown assumes $\kappa_1=40$, $\kappa_2=75$.

Another modified carrier material can also be employed with the present invention is a mixture of hard and soft beads, rather than all soft beads. For example a magnetically hard ferromagnetic material magnetic carrier particles, which (a) comprise a magnetic material exhibiting "hard" magnetic properties, as characterized by a coercivity of at least 300 gauss and (b) exhibit an induced magnetic moment of at least 20 EMU/gm when in an applied field of 1000 gauss can be combine with previous describe soft magnetic materials. The mixture of hard and soft beads particle sizes can range from 5 to 50 micron diameters. The effective permeability of the mixture will be intermediate between those of either the hard or the soft beads individually.

There are a number of ways of demonstrating this. The most straightforward way would be to compute the polarization coefficient of a number of chains with different random mixtures of hard and soft beads.

We can predict what those calculations would show. We do this by making use of the published results of variational calculations (see Torquato [1991], and references cited therein) which predict the range of values that might occur for the magnetic permeability of a mixture of high and low permeability beads as the microgeometry of the mixtures are changes (in this case the high and low permeability beads can occur at different positions in the chain). As discussed by Torquato, there is a sizeable literature devoted to evaluating these variational bounds for a variety of different systems, subject to a wide variety of different symmetry conditions on the composite system. The goal of these various variational calculations are to provide the least separation between the upper and lower bounds (i.e., the most restrictive bounds) compatible with the restrictions on the symmetry of the composite system.

For our system we can not assume much symmetry exists. There is a unique direction implied by the direction of the magnetic field (along which chains tend to align). In addition conditions may be different in the process and cross-process directions. (Crystallographically this symmetry would be called triclinic.) Under such circumstances, we apply the weakest set of bounds, the Voigt-Reuss bounds. In this model, the effective relative magnetic permeability of the random chains lie in the range:

The Voigt (upper) bound is given by:

$$\kappa_{Voigt}=f_1\kappa_1+f_2\kappa_2. \tag{15}$$

where $\kappa_1$ and $\kappa_2$ are the relative permeabilities of the high and low permeability constituents of the alloy, and $f_1$ and $f_2$ are their volume fractions. Similarly, the Reuss (lower) bound is given by:

$$\kappa_{Reuss}=(f_1/\kappa_1)+(f_2/\kappa_2), \tag{16}$$

We expect all random mixtures of high and low relative magnetic permeability beads to yield effective permeabilities enclosed by these bounds. The example assumes $\kappa_1$=40, κ2=75. As we see in the example, the effective permeability of the mixture is intermediate between those of the constituents, with more low permeability material giving a lower effective permeability on is average. As you can see, mixtures make it possible to tune in the permeability you want within a range of uncertainty given by the separation between the upper and lower bounds. Lower effective relative magnetic permeability will decrease the tendency to form long chains, which cause developer bed freezing and height instabilities.

While the invention has been described with reference to the structures disclosed, it is not confined to the specific details set forth, but is intended to cover such modifications or changes as may come within the scope of the following claims:

What is claimed is:

1. In a development system including a developer transport adapted for depositing developer material on an imaging surface having an electrostatic latent image thereon, comprising:

a housing defining a chamber storing a supply of developer material comprising carrier and toner;

a donor member, mounted partially in said chamber and spaced from the imaging surface, for transporting developer on an outer surface thereof to a region opposed from the imaging surface, said donor member having a magnetic assembly having a plurality of poles, a sleeve, enclosing said magnetic assembly, rotating about said magnetic assembly; and a vibrating member positioned between said magnetic assembly and said sleeve at a predefined position around said donor roll, said vibrating member fluidizing said developer material on said donor member to prevent developer bed freezing, to prevent long-range carrier bead chain formation, and to smooth developer bed height-banding on said donor member before a development zone.

2. The development system of claim 1, wherein the carrier comprises soft carrier material.

3. The development system of claim 1, wherein said magnetic assembly has a pole spacing between 1 mm to 1 cm.

4. The development system of claim 3, wherein said sleeve has a thickness between 100 to 350 microns.

5. The development system of claim 1, further comprising a plurality of trim bars positioned about said donor member.

6. The development system of claim 1, wherein said predefine developer bed height is between five and twenty carrier bead diameters, with a preferred value being at ten carrier bead diameters.

7. The development system of claim 1, wherein said donor member is rotated between 200 to 4000 rpm.

8. The development system of claim 1, further comprising means for applying an oscillating electric field between said donor member and imaging surface.

9. The development system of claim 1, wherein said vibrating member vibrates between 1 and 100 KHz.

* * * * *